United States Patent [19]

Meshberg

[11] 4,008,830

[45] Feb. 22, 1977

[54] LIQUID DISPENSER USING A NON VENTED PUMP AND A COLLAPSIBLE PLASTIC BAG

[76] Inventor: Philip Meshberg, 85 Old Oaks Road, Fairfield, Conn. 06430

[22] Filed: Mar. 20, 1975

[21] Appl. No.: 560,301

Related U.S. Application Data

[63] Continuation-in-part of Ser. No. 387,247, Aug. 10, 1973, abandoned.

[52] U.S. Cl. ..... 222/95

[51] Int. Cl.[2] ..... B65D 35/28

[58] Field of Search ..... 222/92, 95, 105, 263, 222/382, 464, 386.5, 96, 383–385

[56] References Cited

UNITED STATES PATENTS

| | | | |
|---|---|---|---|
| 2,612,296 | 9/1952 | Campbell et al. | 222/385 |
| 2,671,578 | 3/1954 | McBean | 222/95 |
| 3,070,265 | 12/1962 | Everett | 222/386.5 |
| 3,211,346 | 10/1965 | Meshberg | 222/263 |
| 3,223,289 | 12/1965 | Bouet | 222/95 X |
| 3,342,377 | 9/1967 | Peredy | 222/95 X |
| 3,378,169 | 4/1968 | Clark | 222/95 |
| 3,549,050 | 12/1970 | Bruce | 222/464 X |

*Primary Examiner*—Stanley H. Tollberg
*Assistant Examiner*—Norman L. Stack, Jr.
*Attorney, Agent, or Firm*—Kenyon & Kenyon Reilly Carr & Chapin

[57] ABSTRACT

A liquid dispenser which permits dispensing liquid or viscous semi-liquid products from an unpressurized container using a non-vented pump in which a rigid outer container open on one end and having a breathing hole holds a flexible collapsible bag, filled with the product to be dispensed; the bag is affixed to the container as by extending through the open container end and the bag ends overlapping the containers edges, and the non-vented pump installed therein placed on or over the open container end so as to seal the bag against the outer container. When operated, the force of the atmospheric pressure, acting through the hole, partially collapses the bag, and forces the liquid to be dispensed into the pump.

10 Claims, 4 Drawing Figures

LIQUID DISPENSER USING A NON VENTED PUMP AND A COLLAPSIBLE PLASTIC BAG

RELATED APPLICATION

This application is a continuation-in-part of application Ser. No. 387,247 filed Aug. 10, 1973, now abandoned.

BACKGROUND OF THE INVENTION

This invention relates to dispensers for liquids and viscous semi-liquid products in general and more particularly to an improved liquid dispenser which utilizes a non-vented pump and does not need to be pressurized.

In my U.S. Pat. No. 3,211,346 there is shown a liquid dispensing apparatus which uses a non-venting pump to dispense liquid from a container. Because each time liquid is pumped out of the container a vacuum would otherwise be created therein, a compressed gas such as nitrogen is added to the container to maintain the product under pressure so that it may all be supplied to the pump and used. Although this dispenser works admirably well, it has a number of limitations. In particular, it is unable to dispense viscous products such as creams, foods (e.g., catsup, mustard, syrups) and liquid vitamins. Even where only a liquid is being dispensed my prior dispenser envisioned the use of metal containers or other heavy rigid containers which are not reusable, which is ecologically bad since they will not naturally recycle for many years. A type of arrangement which permits dispensing viscous products using a similar type of pump is that disclosed in U.S. Pat. No. 3,420,413 to D. F. Corsette. In the dispenser disclosed therein a pump withdraws a liquid or paste product from an air-tight container disposed within a rigid casing and collapsible under atmospheric pressure incident to withdrawal of the contents. It is clear that the air-tight collapsible container disclosed therein is relatively thick as is evidenced by the fact that the mouth of this container is of sufficient thickness to support the pump casing. The disclosed collapsible container, thus, has sufficient structural integrity that it is self-supporting when filled with the product to be dispensed, the use of the other container being primarily to provide a support for the pump to act against while pumping. Corsette discloses in another patent, U.S. Pat. No. 3,288,334 another arrangement of this type in which the collapsible container is constructed so as to be self-supporting even against the action of the pump. Other devices using a collapsible container and a pump are also known, for example the arrangement shown in U.S. Pat. No. 1,585,321 to Wilson. Wilson teaches a dispenser in which the collapsible container is in the nature of a tooth-paste tube or the like. In each of these cases the collapsible tube is essentially self-supporting and can be filled with the material to be dispensed prior to connection to the pump without the need for any additional supporting structure. Although this offers advantages with regard to pre-filling of these collapsible containers it degrades the efficiency of dispensing, since a container which must be structurally strong enough to provide the necessary support can not collapse as easily as might be desired and as a result a loss of material due to material being left in the container after full collapse can occur. Furthermore, in each of these containers the outlet of the collapsible container must be capable of supporting a pump attachment means such as a screw cap. This means that a special molding of the collapsible container is necessary along with a more complex molding of the pump arrangement itself so that it can be properly attached to the container. The problems in obtaining a good, air-tight connection are discussed in the Corsette U.S. Pat. No. 3,420,413 which deals primarily with means for obtaining an air tight connection at the closure between the pump and the collapsible container.

Thin collapsible plastic bags have been previously used, for example, in nursers for babies. Typical of such a collapsible bag is that disclosed in U.S. Pat. No. 3.204,855. A bag of this type insures almost complete collapse so that all the material contained therein will be dispensed. However, bags of this nature have not previously been considered for use in combination with a non-vented pump. Furthermore in these prior art dispensers very little attention has been paid to the use of materials which will naturally recycle when thrown out.

Thus, there is a need for a dispenser capable of dispensing both liquid and viscous products which can operate using a non-venting pump (which is less expensive and easier to manufacture than a venting pump), can be made at a low cost using inexpensive materials, the bulk of which will naturally recycle when thrown out. Furthermore such a dispenser should be capable of dispensing essentially all of the material contained therein and should offer ease of processing, i.e., ease filling and assembly.

SUMMARY OF THE INVENTION

The product dispenser of the present invention fulfills all the above noted requirements. A hollow rigid outer container is lined with a flexible collapsible bag having edges overlapping the end of the container. The bag is filled with the liquid to be dispensed and a cover, which has a non-vented pump installed, is placed over the end to seal the bag against the outer container. The outer container has at least one hole in it so that, as the liquid is pumped out (which creates a differential pressure in the bag), atmospheric pressure will partially collapse the bag and, thus, pressure the liquid to the pump and permit all of it to be dispensed. Since air is not present in the bag, a positive force is exerted directly on the product permitting even viscous products to be supplied to the pump and dispensed.

Since the outer container only supports the weight of the liquid stored in the bag, it can be made of plastic, rigid paper, metal or glass. Paper is particularly attractive for this purpose in view of its low cost and ability to naturally recycle. The inexpensiveness of the outer container along with the ability to use a low-cost non-vented pump permits the total package to be manufactured at a cost well below that of conventional dispensers.

What is meant by a collapsible bag is a collapsible bag of the type disclosed in U.S. Pat. No. 3,204,855, with respect to thickness and collapsibility. Thus, the bag itself is not self-supporting and cannot be filled with the materials to be dispensed prior to its attachment to the outer container. Rather, the outer container must be lined with the plastic bag and then filled. The outer container, thus, not only provides a support for the pump to act against but also provides support against its sides for the plastic bag when filled with material. It is clear that the construction of the outer container and a bag of this nature is much less expensive than the types of containers disclosed in the prior art which were required to have substantial thickness. Furthermore the ease of assembly with the cover being placed over the outer container and flexible bag in a press fit is much simpler than that disclosed in connection with prior devices.

However this first disclosed enbodiment of the invention does require, in its assembly, the step of lining the outer container with the collapsible bag prior to filling. To overcome the need for this step, in accordance with a further embodiment of the present invention the outer container and flexible bag are molded in a single operation. The outer container is molded to have a suitable thickness to support the material and the force of pumping. The inner portion is molded with a thinness of the type referred to above so as to obtain essentially complete collapse and dispensing of all the product. In this embodiment also the outer container provides not only a support for the pump to act against but supports the inner bag during filling. As disclosed, the single molded unit is preferably constructed with sloping sides so that units can easily be stacked for ease in shipping and handling.

In addition, means can be provided to completely evacuate all air from the bag prior to final sealing, thereby allowing products which would deteriorate in the presence of air or a propellant to be stored and dispensed. Similarly the product may easily be pasteurized or irradiated after packing if desired.

Finally, since the outer container is not pressurized it is not essential that it be cylindrical if for asethetic handling or other reason a different shape is preferred.

DETAILED DESCRIPTION OF THE PREFERRED EMBODIMENT

Figure 1:
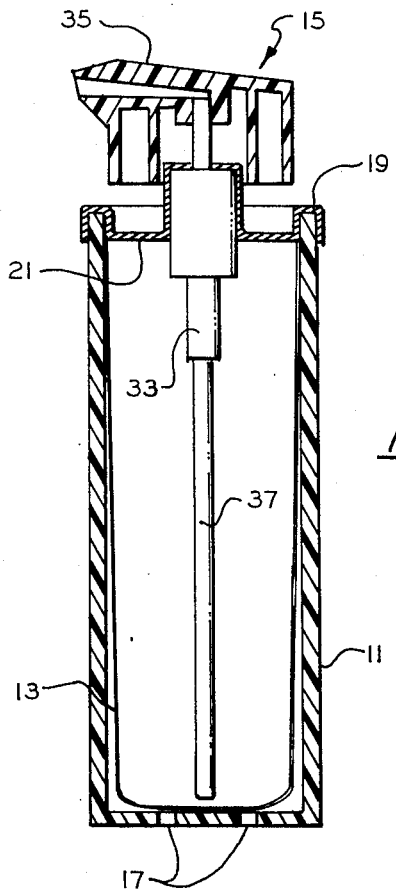
FIG. 1 is a cross sectional view of a dispenser made according to the present invention.

As shown in the FIG. 1, the personal dispenser of the present invention comprises an outer rigid case 11, preferably cylindrical, a flexible bag 13, and a cover and pump assembly indicated generally as 15. The outer case 11 can be made of any suitable rigid material such as plastic, rigid paper, metal or glass. (The ability to use paper makes this container particularly useful from an ecological standpoint). The outer case 11 will contain at least one perforation or hole 17 for reasons to be noted below. The outer case or container 11 has placed within it a flexible bag 13 which is attached to the container preferably by extending up over its edges. Bag 13 will preferably be made of one of the soft flexible impermeable plastic materials well known in the art. (It may also be made of wax paper.) As noted above, it can be made of a thickness and consistency of the plastic bag disclosed in U.S. Pat. No. 3,204,855. Because of its extreme flexibility the bag is not self-supporting and must be placed within the outer case or container 11 prior to being filled. This additional flexibility insures that essentially all material will be dispensed.

The cover and pump assembly 15 is constructed so as to have an annular lip portion 19 which will press fit over the top edges of the outer container 11 and the portion of bag 13 overlapping these edges and will thereby seal this top edge. Assembly 15 comprises a circular top section 21, into which a pump 23 is installed, and a dispensing actuator 35 mounted atop the pump. A dip tube 37 extends down from the pump to the bottom of the bag 13. The construction of cover and pump assembly 15 can be made in accordance with my above referenced U.S. Pat. No. 3,211,346.

When it is desired to prepare a container of some product to be dispensed, the outside container 11 will have the plastic bag 13 inserted therein. The bag 13 will then be filled with the liquid product to be dispensed and the cover portion 15 will be pressed down on the ends of the container 11 to seal the product therein. If desired, means can be provided for evacuating any remaining air prior to final sealing.

In operation, the inlet valve of the pump is controlled by movement of the stem. Because of its design, which does not permit liquid entry until it is near its uppermost position, the piston therein creates an unusually differential pressure as it is released and pushed up by the compression spring. This pressure differential will cause the stored product to be pressured, by the atmospheric pressure acting on the bag, to fill the pump chamber so that a measured amount of product will be dispensed with each stroke of the pump. The flexibility of the bag 13 and the perforation 17 in the outer container, permit outside air pressure to act on the bag causing it to partially collapse, and pressure the liquid up through the dip tube to the pump chamber until the bag is completely empty. The container can be operated in any position since the volume of the bag will always be that of the remaining product. This means the material canot flow away from the dip tube 37 when the container is turned upside down since there is no air within the collapsed bag. The absence of air and the positive force of the atmospheric pressure directly on the product through the collapsed bag is also what makes possible dispensing viscous products. Air bubbles cannot form within the collapsed bag to prevent product from reaching the dip tube. To avoid any stopping of the dip tube 37, its bottom portion may be made uneven and/or the bag 13 may be attached to the bottom of container 11 with a spot of adhesive just below the dip tube. Also, the external surface of the dip tube may be fluted, or irregularly patterned, and/or a screen placed around it to facilitate the flow of the last product to the opening at its end as the bag collapses against it.

Figure 2:
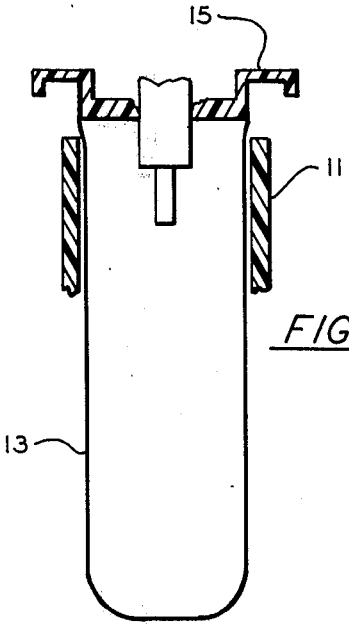
FIGS. 2 and 3 are partial cross-sectional views showing alternate ways of attaching the flexible bag of FIG. 1.
Figure 3:
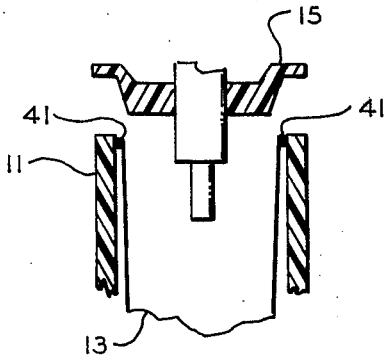

FIGS. 2 and 3 show alternate ways of attaching the plastic bag 13. As shown in FIG. 2 the bag 13 may be attached to the cover assembly 15 and then the two together placed in the outer case 11. In this manner a simple but air-tight connection between flexible bag 13 and the cover and pump assembly 15 is insured. With this method of assembly some auxiliary means would have to be provided in the cover for filling since the difficulty of attaching a filled bag or for that matter even handling such a filled bag is evident. Thus, the embodiment of FIG. 1 described above or the embodiment of FIG. 3 below are preferred over this embodiment.

In the embodiment of FIG. 3, the bag 13 is attached to the inside of outer case 11 at the top using, for example, glue 41 and the top and pump assembly then inserted. These are shown only by example and other means of assembly may also be used. The only two requirements which must be met are that the bag 13 is sealed to the top and pump assembly 15 and that the bag is supported by the walls of the outer case 11. To provide air pressure to collapse the bag, one or more perforations 17, which may be located in the bottom of container 11, as shown, or around its sides, may be used.

Figure 4:
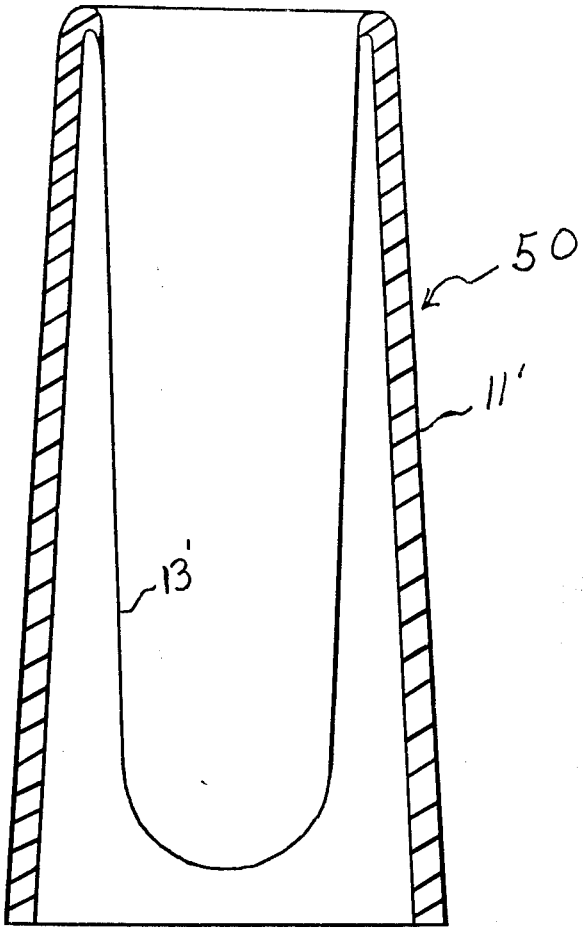
FIG. 4 is a cross-sectional view illustrating an alternate form of construction in which the outer container and flexible bag are made in a single unit.

FIG. 4 illustrates a particularly simple way of constructing the outer container and flexible bag. In the embodiment shown thereon, a single molded unit 50 comprising thick outer walls 11 and a thin inner bag 13 is provided. This avoids the necessity of inserting a flexible bag upon assembly. When the dispenser is to be filled and assembled, it is only necessary to fill the inner bag 13 with the material to be dispensed and place an assembly such as assembly 15 onto the cover 11 or 11' has been indicated the assembly 15 can in this latter embodiment also be a screw cover with appropriate threads provided on the outer container 11' and the flange of the assembly 15. Similarly, the embodiment of FIGS. 2 and 3 would be adaptable to a screw connection. However, it is anticipated that difficulties would be encountered in this type of assembly in FIG. 1. This will be due the tendency of the plastic bag to be pulled or torn by the threads. In any case, the press fit arrangement offers a simpler and more efficient means of attachment.

Thus, an improved liquid dispenser which permits dispensing liquid and viscous products using a non-vented pump without using pressurization within the dispenser container has been shown. Although specific embodiments have been illustrated and described, it will be obvious to those skilled in the art that various modifications may be made without departing from the spirit of the invention which is intended to be limited solely by the appended claims.

What is claimed is:

1. A product dispenser which permits dispensing semi-liquid and viscous products without placing the product in a pressurized container comprising:

a. a rigid outer hollow container open on one end having at least one perforation therein;

b. a thin flexible bag incapable of self-support supported by and within said container with its open end extending over the edges of said outer container;

c. a cover having mounted therein a non-vented pump and containing an annular recess matched to said container press fitted over said outer container to seal said bag to itself and to said container, placing said pump in sealing relation with said bag, said pump comprising a cylinder having a pumping piston therein in engagement with the sides of the cylinder, a reciprocating valve stem normally projecting from said cover and having a dispensing means on the end thereof, said stem having means thereon for operating said piston and means for controlling the flow of material to and from said cylinder, said stem in a normal position connecting the cylinder to the inside of said bag, initial movement of the stem inwardly from a normal position closing off the cylinder from the bag and connecting the dispensing means to the cylinder and continual movement of the stem causing the piston to move in the cylinder and force the material therein through the dispensing means, said stem maintaining said cylinder closed off from the inside of said bag until said stem reaches a position which is almost its normal position and d. a dip tube extending to the bottom of said bag having an uneven end to prevent the bag from stopping the end of said tube and having grooved sides to permit the product to flow along it to the open end without being stopped by the bag collapsing around said tube whereby prior to sealing said bag may be filled with the material to be dispensed and whereby the air pressure admitted through said perforation exerts a pressure on the outer wall of said bag causing the product to fill the pump cylinder each time the pump is operated and the cylinder emptied as said flexible bag is collapsed by said same air pressure.

2. A product dispenser which permits dispensing liquid and semi-liquid viscous products using a non-vented pump without placing the product in a pressurized container comprising:

a. a container consisting of a rigid outer hollow container open at one end and having at least one perforation therein and molded intergrally therewith and connected to said one end a thin flexible bag incapable of self-support supported by and within said container, said outer hollow container being in the shape of a truncated cone with its large end at the other end from said open end, and the sides of said bag similarly being in the shape of a truncated cone with its larger portion at the open end of said container;

b. a cover having therein a non-vented pump including a cylinder, a piston and dispensing stem operatively coupled to said piston, an inlet to said cylinder at the bottom of said pump and an outlet from said cylinder formed in said stem, said stem extending from said cover at the top of said pump, said cover placed over said opened end of said container and in sealing relationship with said thin flexible bag; and c. a dip tube extending from the inlet of said cylinder into said bag, said dip tube including means to prevent said bag from collapsing around an opening therein, whereby prior to sealing said bag may be filled with a product to be dispensed and whereby the air pressure admitted through said perforation exerts a pressure on the outer wall of said bag causing the product to fill the pump chamber each time the pump is operated and the chamber is emptied as said flexible bag is collapsed by said same air pressure and whereby the intergral structure including said rigid outer hollow container and thin flexible bag can be stacked prior to filling and covering.

3. The invention according to claim 2 wherein the end of said tube is made uneven to prevent said bag from stopping the end of said tube.

4. The invention according to claim 3 wherein the sides of said tube are grooved to permit product to flow along it to the open end of said tube without being stopped by the bag collapsing around the tube.

5. The invention according to claim 2 wherein said bag is attached to the bottom of said outer container at a point below said dip tube to prevent its leaning against the end of said dip tube and restricting the flow of product into said tube.

6. The invention according to claim 1 wherein said outer container is made of rigid paper.

7. The invention according to claim 1 wherein said outer container is made of plastic.

8. The invention according to claim 1 wherein said outer container is made of glass.

9. The invention according to claim 1 wherein said outer container is made of metal.

10. The invention according to claim 1 wherein said flexible bag is a plastic bag.

* * * * *